US006651353B1

(12) United States Patent
Evans et al.

(10) Patent No.: US 6,651,353 B1
(45) Date of Patent: Nov. 25, 2003

(54) RAIL ALIGNMENT TOOL

(75) Inventors: Donald G. Evans, Keller, TX (US); Charles V. Blackwell, Cuba, MO (US); Terry E. Turner, Rolla, MO (US); Bobby L. Smith, Cuba, MO (US)

(73) Assignee: The Burlington Northern and Santa Fe Railway Company, Fort Worth, TX (US)

( * ) Notice: Subject to any disclaimer, the term of this patent is extended or adjusted under 35 U.S.C. 154(b) by 168 days.

(21) Appl. No.: 09/947,844

(22) Filed: Sep. 6, 2001

Related U.S. Application Data

(63) Continuation-in-part of application No. 09/634,899, filed on Aug. 9, 2000, now Pat. No. 6,385,861.

(60) Provisional application No. 60/147,963, filed on Aug. 9, 1999.

(51) Int. Cl.[7] ..... E01B 29/04; E01B 33/00; B25B 27/14; B25B 1/20

(52) U.S. Cl. ..... 33/651.1; 269/43; 104/2; 104/7.2; 29/271

(58) Field of Search ..... 33/651.1, 613, 33/645, 521, 523, 523.1, 651, 1 Q, 287, 338, 533; 269/33; 29/271, 272; 228/49.3, 49.4; 104/2, 7.2

(56) References Cited

U.S. PATENT DOCUMENTS

| | | | | | |
|---|---|---|---|---|---|
| 700,994 | A | | 5/1902 | Torre et al. | 219/53 |
| 3,711,920 | A | * | 1/1973 | Simmons, Jr. | 269/43 |
| 3,888,477 | A | * | 6/1975 | Tate | 269/43 |
| 4,195,828 | A | * | 4/1980 | Peterson | 269/43 |
| 4,270,036 | A | | 5/1981 | Zollinger | 219/53 |
| 4,320,708 | A | | 3/1982 | Bommart | 104/112 |
| 4,413,415 | A | * | 11/1983 | Stovall | 269/43 |
| 4,641,818 | A | | 2/1987 | Bommart | 269/43 |
| 4,674,730 | A | | 6/1987 | Roberts | 269/43 |

(List continued on next page.)

FOREIGN PATENT DOCUMENTS

| | | | |
|---|---|---|---|
| DE | 32-09-984 A1 * | 10/1981 | 269/43 |

*Primary Examiner*—Randy Gibson
(74) *Attorney, Agent, or Firm*—Hill&Hunn LLP

(57) ABSTRACT

A rail alignment system for locating a first end piece and a second end piece of a first rail section and a second rail section. The rail alignment system comprises (a) a first rail alignment tool for engaging and applying force to said first rail section; and (b) a second rail alignment tool for engaging and applying force to said second rail section. The first rail alignment tool includes: (1) a planar plate for extending transversely beneath said first rail section; (2) a pair of block members, each secured to said planar plate and each defining a threaded cavity which is substantially orthogonal to said first rail section and which are aligned with one another; (3) a pair of externally threaded bolts, each adapted for engaging one of said threaded cavities of said pair of block members; and (4) a pair of contoured rail engagement end pieces, each secured to an inner terminating portion of said pair of externally threaded bolts for engaging said first rail section. The second rail alignment tool includes: (1) a planar plate for extending transversely beneath said second rail section; (2) a pair of block members, each secured to said planar plate and each defining a threaded cavity which is substantially orthogonal to said second rail section and which are aligned with one another; (3) a pair of externally threaded bolts, each adapted for engaging one of said cavities of said pair of block members; and (4) a pair of contoured rail engagement end pieces, each secured to an inner terminating portion of said pair of externally threaded bolts for engaging said second rail section. Said first end piece of said first rail section and said second rail section may be aligned by selectively applying torque to said two pair of externally threaded bolts.

20 Claims, 5 Drawing Sheets

U.S. PATENT DOCUMENTS 4,750,662 A * 6/1988 Kagimoto ..... 269/83
4,800,817 A 1/1989 Carstensen et al. ..... 104/2
4,960,137 A * 10/1990 Pott et al. ..... 269/43
5,094,004 A * 3/1992 Wooten ..... 33/338
5,297,482 A * 3/1994 Cleveland ..... 104/7.2
5,575,416 A 11/1996 Oellerer et al. ..... 228/49.1
6,220,169 B1 * 4/2001 Rosenquist ..... 104/2

* cited by examiner

RAIL ALIGNMENT TOOL

CROSS REFERENCE TO RELATED APPLICATIONS

This application is a Continuation-in-Part of U.S. application Ser. No. 09/634,899, filed Aug. 9, 2000, titled "Rail Alignment Tool," now U.S. pat. No. 6,358,861 which claimed the benefit of U.S. Provisional Application No. 60/147,963, filed Aug. 9, 1999, titled "Rail Alignment Tool."

BACKGROUND OF THE INVENTION

1. Field of the Invention

The present invention relates in general to tools which are utilized to align railroad rails, and in particular to tools which are utilized to align abutting rails in order to allow welding of the rails together.

2. Description of the Prior Art

All railroads have a considerable investment in their infrastructure. However, the infrastructure requires continuous attention and repair. For example, as rail becomes worn or damaged, it must be replaced. Currently, rail is in relatively long continuous sections; however, these sections must be butt welded together in order to allow for safe and efficient locomotion over the rail. In the prior art, in order to get a good weldment between the end pieces of rail sections, work crews have utilized manual equipment, such as mauls, hammers, and wedges to align the ends of the rails prior to welding. Having railroad crews operate this heavy equipment inherently carries a risk of injury to the employee. For example, when aligning rails with wedges, metal chips may fly off of the wedges when they are struck by hammers during the hammering and wedging operations, resulting in injuries to the workers. Additionally, using the heavy equipment is also inherently risky. Any new rail equipment which can reduce the risk of injury to rail crews is typically quickly and readily adopted by the industry.

SUMMARY OF THE INVENTION

It is one objective of the present invention to provide a rail alignment tool which replaces the utilization of mauls, hammers, and wedges in order to align rail ends prior to welding.

It is another objective of the present invention to provide an improved rail alignment tool which allows rail pieces to be aligned, but which only requires the work crew to apply torque to a plurality of threaded bolt members, which is far safer than utilizing mauls, hammers, and wedges.

It is yet another objective of the present invention to provide an improved rail alignment tool which is durable, lightweight, and which requires little or no maintenance, but which is safe to operate and which provides for good alignment of rail sections to allow for good welds to be made between adjoining rail sections.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

DETAILED DESCRIPTION OF THE INVENTION

Figure 1:
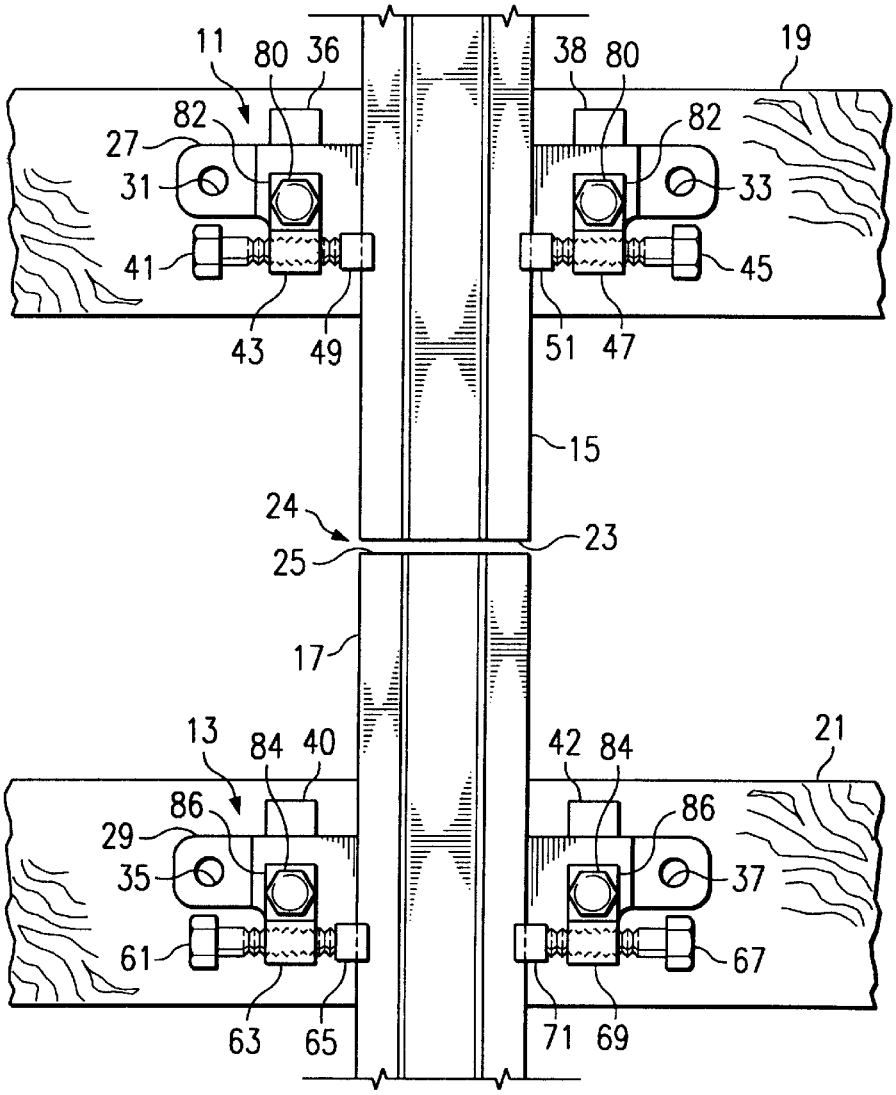
FIG. 1 plan view of the rail alignment tools according to one embodiment of the present invention in use to align two sections of rail prior to welding.

Referring to FIG. 1 in the drawings, one embodiment of the rail alignment system according to the present invention is illustrated. Rail alignment tools 11, 13 are shown being utilized to align rail segments 15, 17 in abutting relationship in order to obtain alignment between rails 15, 17 prior to the welding together of rails 15,17. Rail alignment tool 11 is utilized to selectively locate an end 23 of rail 15, while rail alignment tool 13 is utilized to selectively locate an end 25 of rail 17. Rail alignment tools 11, 13 may be adjusted incrementally in order to provide for a desired alignment of rails 15, 17. Rail alignment tool 11 includes a base member 27 that is configured for attachment to a cross tie 19. Similarly, rail alignment tool 13 includes a base member 29 that is configured for attachment to a cross tie 21. Although it is preferred that rail alignment tools 11, 13 be mirror images of each other, it should be understood that in certain applications, it may be desired that rail alignment tool 11 have a different configuration than rail alignment tool 13.

The rail alignment system according to the present invention includes a means for securing rail alignment tools 11, 13 to cross ties 19, 21, such that rail alignment tools 11, 13 may be used with wooden cross ties, concrete cross ties, or cross ties made of any other conventional material. To accommodate use with wooden ties, base member 27 includes spike ports 31, 33 through which may driven conventional railroad spikes 40 (see FIG. 3) to secure base member 27 in a fixed position relative to cross tie 19. Likewise, base member 29 includes spike ports 35, 37 through which may driven conventional railroad spikes 40 to secure base member 29 in a fixed position relative to cross tie 21. To accommodate use with concrete ties, base member 27 includes tabs 36, 38 which are configured for connection to rail clips (not shown) to secure base member 27 in a fixed position relative to cross tie 19. The rail clips are used to secure the rails to the concrete cross ties. Similarly, base member 29 includes tabs 40, 42 which are configured for connection to the rail clips (not shown) to secure base member 29 in a fixed position relative to cross tie 21. It will be appreciated that the means for securing rail alignment tools 11,13 to cross ties 19, 21 may take on other forms.

It is preferred that base member 27 be disposed between rail 15 and cross tie 19; however, it should be understood that base member 27 may be disposed at other locations relative to rail 15 and cross tie 19 without affecting the functionality of rail alignment tool 11. For example, base member 27 may be configured to function from positions above or to either side of rail 15.

Rail alignment tool 11 includes adjustment members 41, 45 which are preferably disposed transverse to rail 15. Adjustment members 41, 45 are utilized to adjustably move end 23 of rail 15 in a transverse direction relative to cross tie 19. Adjustment member 41 is coupled to base member 27 via a coupling 43, and adjustment member 45 is coupled to base member 32 via a coupling 47. Adjustment member 41 terminates with a rail engagement member 49, and adjustment member 45 terminates with a similar rail engagement member 51. Rail engagement members 49, 51 are configured to engage rail 15. In other words, rail engagement members 49, 51 are profiled or contoured in a manner which provides for good mating contact with a portion of rail 15. It is preferred that adjustment members 41, 45 include external threads and that couplings 43, 47 include fixed, mating internal threads in order to allow for efficient transfer of force from adjustment members 41, 45 to rail 15. Thus, as adjustment members 41, 45 are rotated back and forth, rail engagement members 49, 51 advance and retract in a transverse direction relative to rail 15 in a manner which collectively fixes the location of end 23 of rail 15.

In a similar fashion, rail alignment tool 13 includes adjustment members 61, 67 which are preferably disposed transverse to rail 17. Adjustment members 61, 67 are utilized to adjustably move end 25 of rail 17 in a transverse direction relative to cross tie 21. Adjustment member 61 is coupled to base member 29 via a coupling 63, and adjustment member 67 is coupled to base member 34 via a coupling 69. Adjustment member 61 terminates with a rail engagement member 65, and adjustment member 67 terminates with a similar rail engagement member 71. Rail engagement members 65, 71 are configured to engage rail 17. In other words, rail engagement members 65, 71 are profiled or contoured in a manner which provides for good mating contact with a portion of rail 17. It is preferred that adjustment members 61, 67 include external threads and that couplings 63, 69 include fixed, mating internal threads in order to allow for efficient transfer of force from adjustment members 61, 67 to rail 17. Thus, as adjustment members 61, 67 are rotated back and forth, rail engagement members 65, 71 advance and retract in a transverse direction relative to rail 17 in a manner which collectively fixes the location of end 25 of rail 17.

Rail alignment tool 11 includes at least one means 80 for adjusting the height of rail alignment tool 11, and rail alignment tool 13 includes at least one means 84 for adjusting the height of rail alignment tool 13. Means 80 is preferably a threaded adjustment screw that is coupled to base member 27 via a coupling 82 and passes through base member 27 to contact cross tie 19. Likewise, means 84 is preferably a threaded adjustment screw that is coupled to base member 29 via a coupling 86 and passes through base member 29 to contact cross tie 21. Means 80, 82 are utilized to adjustably raise ends 23, 25 of rails 15, 17 in a vertical direction relative to cross ties 19, 21, respectively. It is preferred that means 80, 84 include external threads and that couplings 82, 86 include fixed, mating internal threads in order to allow for efficient transfer of force from means 80, 84 to rails 15, 17. Thus, as means 80, 84 are rotated back and forth, base members 27, 29 raise and lower in a vertical direction relative to cross ties 19, 21, thereby, raising and lowering ends 23, 25 of rails 15,17, respectively. It should be understood that means 80, 84 may include other methods of raising ends 23, 25.

Figure 2:
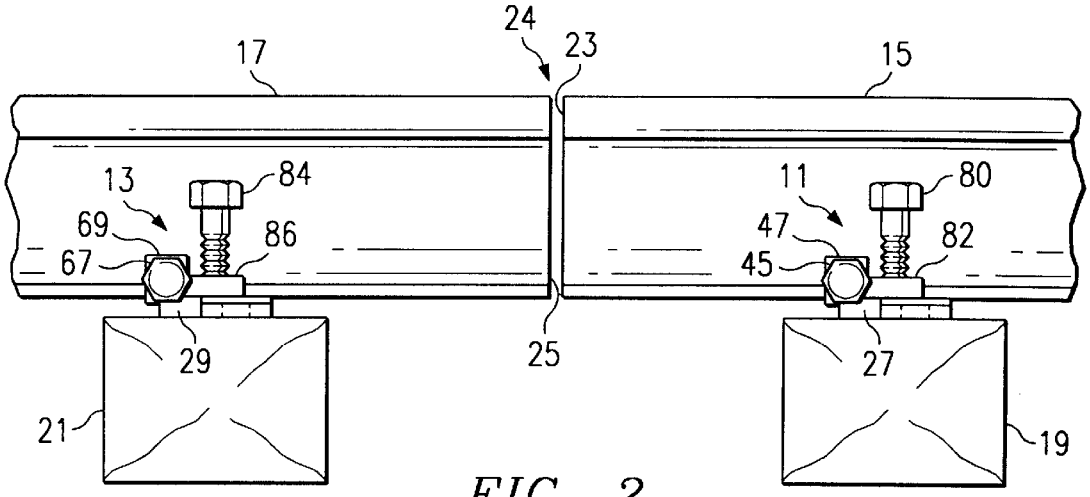
FIG. 2 is a right side view of the rail alignment tools of FIG. 1.

Referring now to FIG. 2 in the drawings, rail alignment tools 11, 13 are illustrated in a right side view. As is shown, base members 27, 29 are disposed between cross ties 19, 21 and rails 15, 17. As torque is applied to adjustment members 41, 45, 61, 67, rail engagement members 49, 51, 65, 71 are moved inward and outward relative to base members 27, 29 in order to determine the lateral location of ends 23, 25 of rails 15, 17, thereby placing ends 23, 25 of rails 15, 17 in proper lateral alignment for welding. In addition, as torque is applied to means 80, 84, base members 27, 29 are moved upward and downward relative to cross ties 19, 21 in order to determine the vertical location of ends 23, 25 of rails 15, 17, thereby placing ends 23, 25 of rails 15, 17 in proper vertical alignment for welding. Once ends 23, 25 of rails 15, 17 are properly aligned, a welding crew may perform a butt weld between rails 15, 17 in order to create a continuous section of rail. In other words, a gap 24 between ends 23, 25, which is exaggerated in the views of FIGS. 1 and 2, is closed by the butt weld. After rails 15, 17 have been welded together, adjustment members 41, 45, 61, 67 are loosened, spikes 40 are removed from cross ties 19, 21 by conventional means, and rail alignment tools 11,13 are removed.

Figure 3:
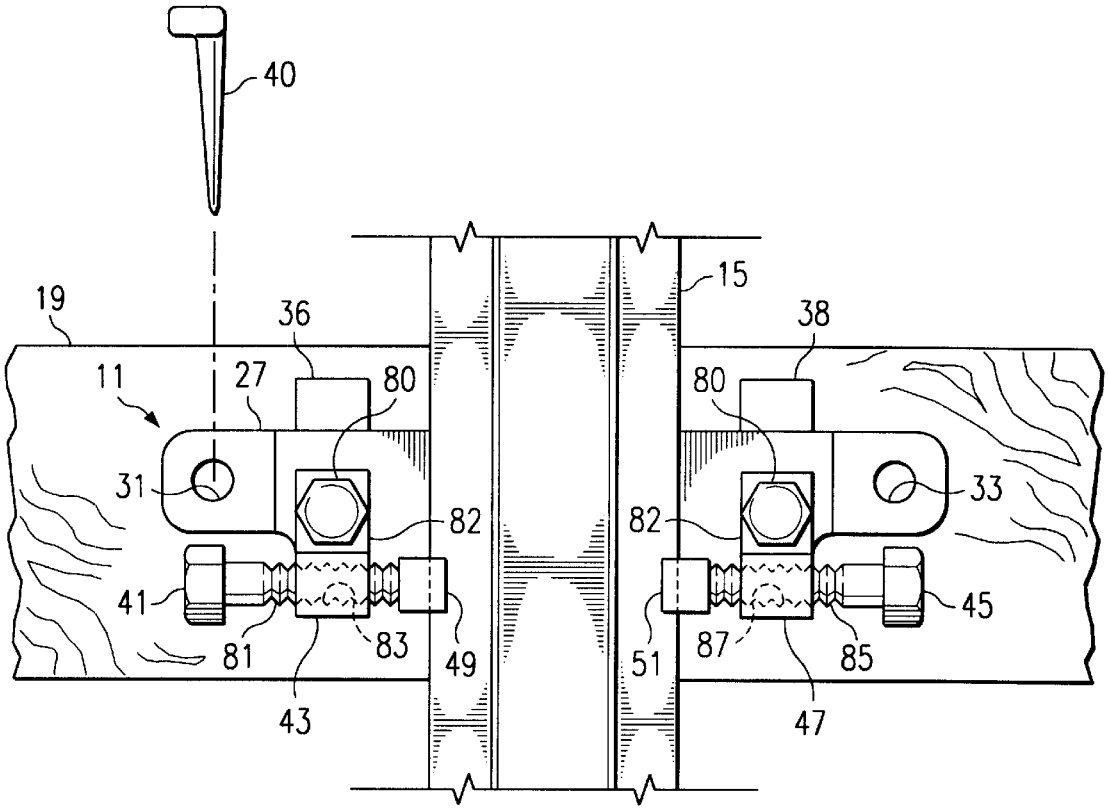
FIG. 3 is an enlarged plan view of one of the rail alignment tools of FIG. 1.

Referring now to FIG. 3 in the drawings, a detailed view of rail alignment tool 11 of FIG. 1 is illustrated. As is shown, adjustment member 41 includes exterior threads 81 and coupling 43 includes interior threads 83. Rotation of adjustment member 41 in one direction advances rail engagement member 49 inward toward rail 15, while rotation of adjustment member 41 in the opposite direction moves rail engagement member 49 outward relative to rail 15. Likewise, adjustment member 45 includes external threads 85, while coupling 47 includes internal threads 87. Rotation of adjustment member 45 in one direction will advance rail engagement member 51 inward toward rail 15, while rotation of adjustment member 45 in the opposite direction will move rail engagement member 51 outward from rail 15.

Figure 4:
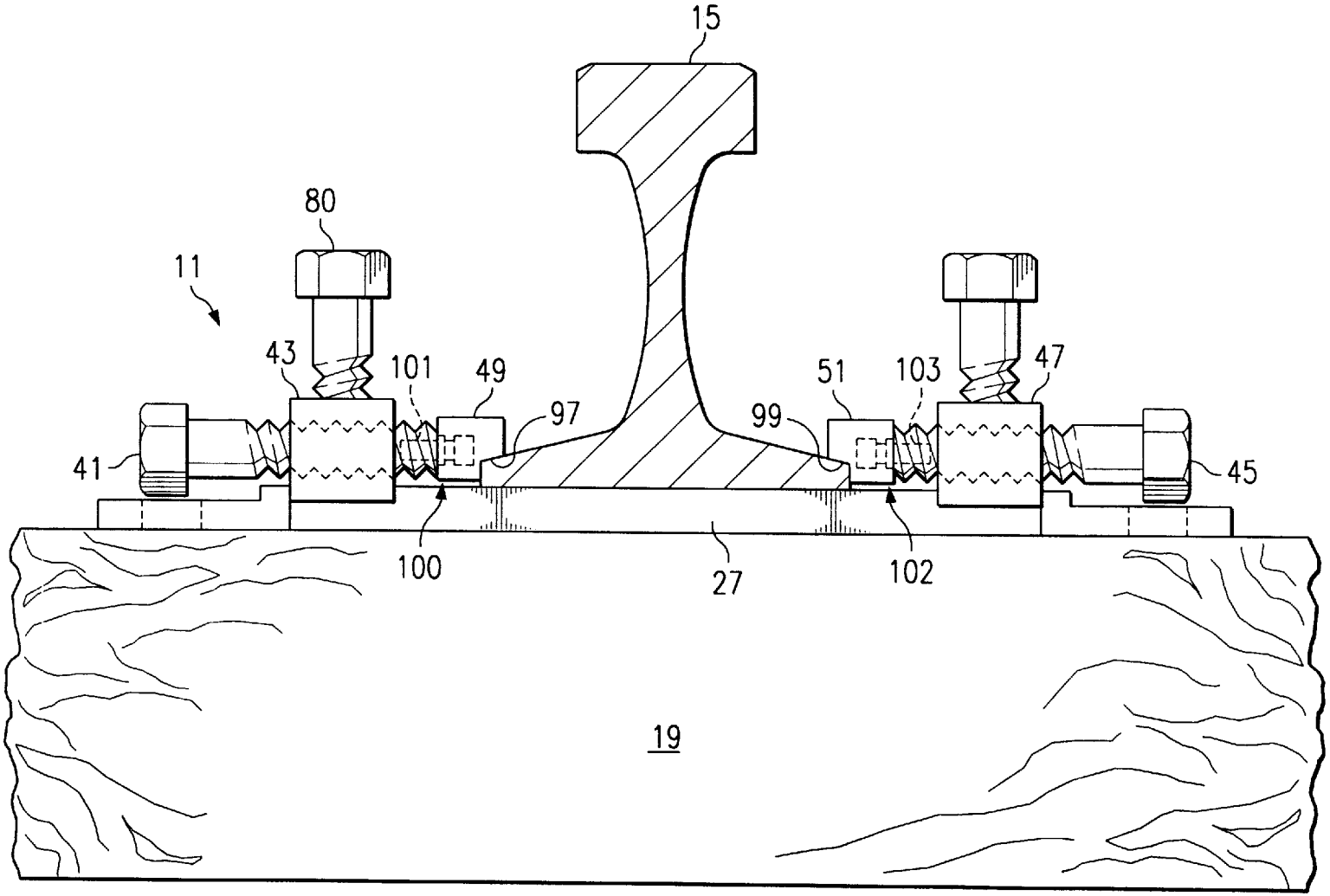
FIG. 4 is a front view of one of the rail alignment tools of FIG. 1.

Referring now to FIG. 4 in the drawings, a simplified longitudinal section view of rail alignment tool 11 as utilized to engage rail 15 is illustrated. As is shown, base member 27 is disposed between rail. 15 and cross tie 19. Adjustment members 41, 45 may be adjusted relative to couplings 43, 47 in order to put rail engagement members 49, 51 in force-transference engagement with the bottom flanges of rail 15. As is shown, rail engagement members 49, 51 include contoured outer ends 97, 99 which are configured to matingly engage the bottom flanges of rail 15 at the corner or shoulder portion of the flanges so that force is transferred in the vertical and transverse directions. Preferably, rail engagement members 49, 51 include swivel couplings 100, 102 which have some inherent "adaptability" as they engage rail 15, but which become more rigid as force is applied through the adjustment of adjustment members 41, 45. As is shown, couplings 100, 102 may be secured to adjustment members 41, 45 at cavities 101,103 formed in the ends of adjustment members 41, 45.

Figure 5:
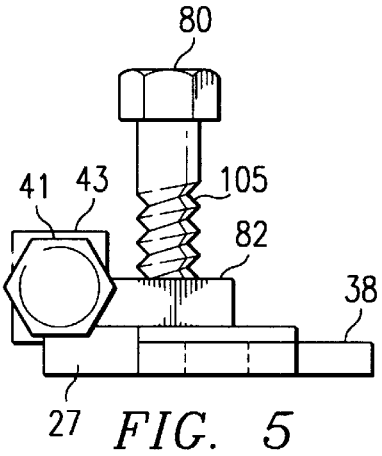
FIG. 5 is a right side view of one of the rail alignment tools of FIG. 1.
Figure 6:
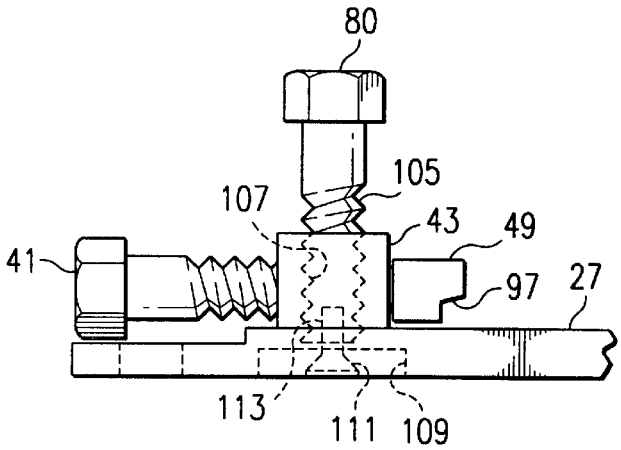
FIG. 6 is a partial front view of the rail alignment tool of FIG. 4.

Referring now to FIGS. 5 and 6 in the drawings, rail alignment tool 11 is illustrated in a right side view and a slightly enlarged front view, respectively. The relative position of adjustment member 41 and means 80 is shown. In these views, the operation of means 80 for adjusting the height of rail alignment tool 11 is depicted. As is shown, means 80 preferably includes external threads 105. Coupling 82 includes a vertical port having internal threads 107 that mate with external threads 105. A counter bore 113 is provided at the lower end of means 80. Counter bore 113 is adapted to receive a jack member 111. When means 80 is fully retracted relative to base member 27, jack member 111 is disposed within a recess 109 on the bottom surface of base member 27. As means 80 is rotated, it extends through base member 27 causing jack member 111 to come into contact with cross tie 19. Further downward extension of means 80 causes base member to rise relative to cross tie 19. In this manner, base member 27 may be raised and lowered relative to cross tie 19 in order to fix the vertical position of end 23 of rail 15.

Referring now to FIGS. 7A, 7B, 8, 9A, and 9B, the preferred embodiment of the rail alignment tool and system according to the present invention is illustrated. In this embodiment a rail alignment tool 201 performs the same functions of rail alignment tool 11 by employing a slightly different methodology. Although only one rail alignment tool 201 is illustrated, it will be understood that in this embodiment, two such rail alignment tools 201 are employed, one on each section of adjoining rail.

Figure 7A:
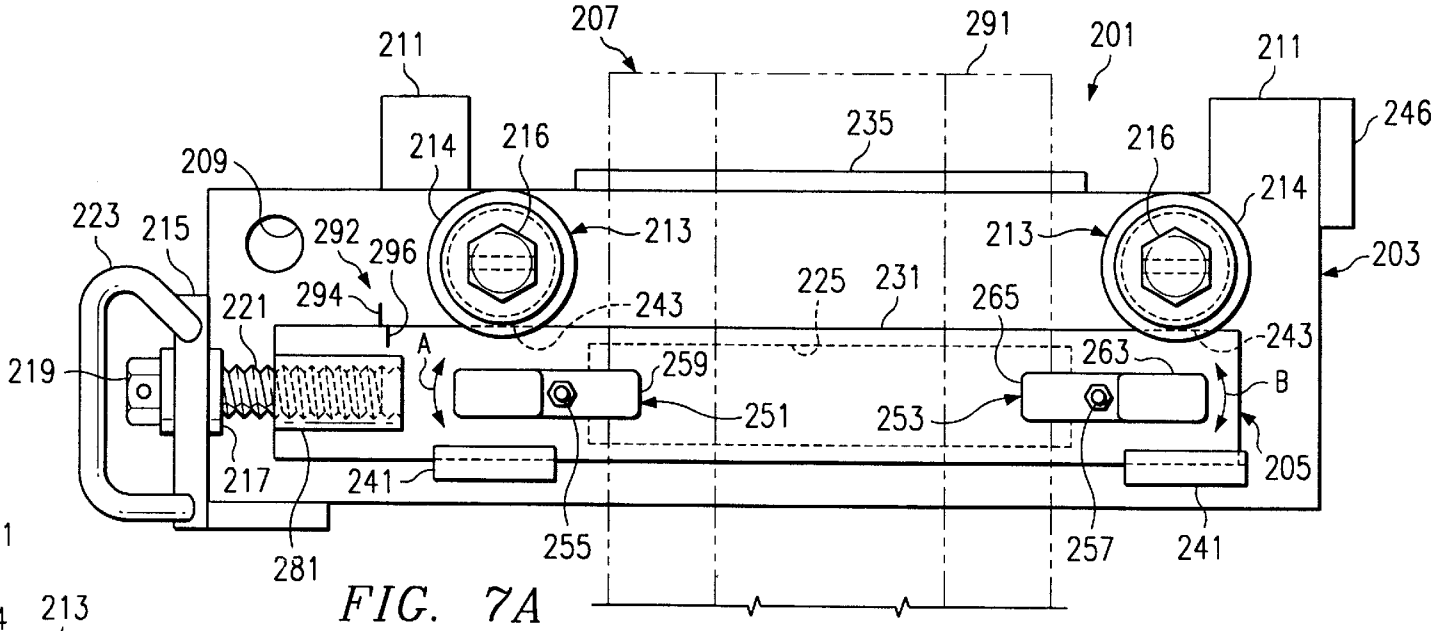
FIGS. 7A and 7B are plan and left side views, respectively, of the preferred embodiment of the rail alignment tool according to the present invention.
Figure 7B:
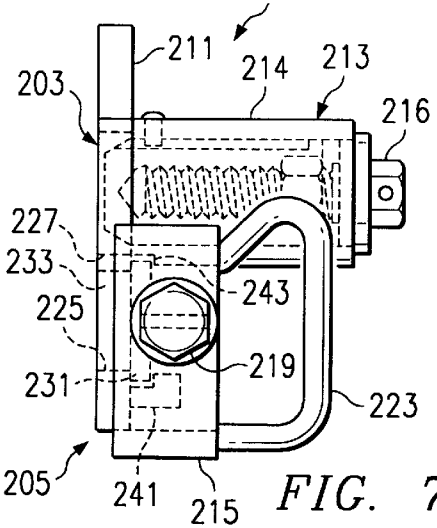

Referring now specifically to FIGS. 7A and 7B in the drawings, rail alignment tool 201 is illustrated in a top plan view and a left side view, respectively. Rail alignment tool 201 includes a base member 203 and a sliding carriage member 205 that translates longitudinally relative to base member 203, and transversely relative to a rail 207. Base member 203 includes at least one spike port 209 through which a conventional rail road spike (not shown) may be driven to secure rail alignment tool 201 to a wooden cross tie (not shown). To accommodate use with concrete ties, base member 203 includes tabs 211, 213 which are configured for connection to rail clips (not shown) to secure rail alignment tool 201 in a fixed position relative to the concrete cross tie (not shown). As mentioned above, the rail clips are used to secure the rails to the concrete cross ties.

Base member 203 carries at least one jack member 213 for lifting base member 203 relative to the cross tie. Jack member 213 includes a protective sleeve portion 214, and a vertical adjustment means 216. Jack members 213 will be discussed in more detail with respect to FIGS. 9A and 9B.

Base member 203 includes an upraised block member 215. In the preferred configuration of this embodiment, block member 215 includes an aperture through which is fitted thrust bearings 217 having internal threads (not shown). A threaded shaft 219 having mating external threads 221 passes through thrust bearings 217. At least one handle 223 to aid in carrying rail alignment tool 201 is coupled to base member 203.

Figure 8:
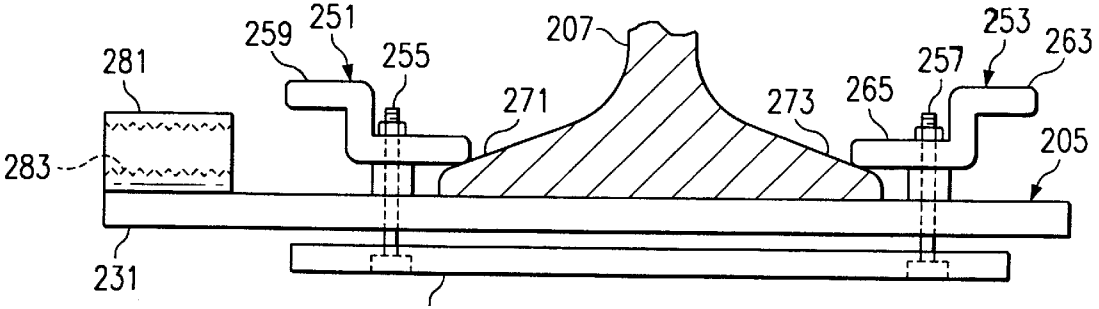
FIG. 8 is a front view of a sliding plate of the rail alignment tool of FIG. 7A.

Additionally referring now to FIG. 8 in the drawings, carriage member 205 is illustrated in a front view. Carriage member 205 translates longitudinally relative to base member 203, and transversely relative to a rail 207. In the preferred configuration, base member 203 includes an elongated aperture 225. Aperture 225 includes a counter bored portion that forms a recessed portion 227 having a flanged surface that is exposed to the underneath surface of base member 203. Carriage member 205 includes an upper plate 231 and a lower plate 233. Upper plate 231 is wider and longer than elongated aperture 225, such that upper plate translates upon the upper surface of base member 203 over elongated aperture 225. Lower plate 233 is wider than elongated aperture, but not as wide and not as thick as the counter bored portion, such that lower plate 233 is either flush with the underneath surface of base member 203, or entirely disposed within recessed portion 227. Upper plate 231 is coupled to lower plate 233 via one or more pivot pins 255, 257. In this manner, base member 203 is sandwiched between upper plate 231 and lower plate 233 of carriage member 205.

Because upper plate 231 is disposed on the upper surface of base member 203, and because the rail is carried on the upper surface of upper plate 231, an upraised lip 235 is provided to ensure that base member 203 and the underneath surface of rail 207 remain substantially coplanar. It should be understood that upper plate 231 may be configured to be flush with the upper surface of base member 203 without affecting the functionality of rail alignment tool 201.

At least one guide means 241 may be coupled to base member 203 to ensure that carriage member 205 translates in the desired direction. In addition, sleeve portions 214 of jack members 213 may include guide means 243 to further ensure that carriage member 205 translates in the desired direction. Other guide members and alignment tabs, such as alignment tab 246, may be included on rail alignment tool 201 to aid in properly attaching and aligning rail alignment tool 201 to and with the cross tie.

Carriage member 205 includes clamping means 251, 253 for clamping rail 207 to rail alignment tool 201. Clamping means 251, 253 are pivotally coupled to carriage member 205 by pivot pins 255, 257, respectively. Clamping means 251 includes a handle portion 257 and a rail engagement portion 259. Likewise, clamping means 253 includes a handle portion 263 and a rail engagement portion 265. By rotating clamping means 251 with handle portion 257 in the directions of arrow A, rail engagement portion 259 engages and disengages one lower flange 271 of rail 207. In a similar fashion, by rotating clamping means 253 with handle portion 263 in the directions of arrow B, rail engagement portion 265 engages and disengages the opposing lower flange 273 of rail 207. In this manner, rail 207 is secured to carriage member 205.

Carriage member 205 includes a receiver 281 having internal threads 283 for matingly receiving threaded shaft 219. Thus, rotation of threaded shaft 219 causes carriage member 205 to translate longitudinally relative to base member 203 along elongated aperture 225. Once base member 203 is secured to the cross tie, and rail 207 is clamped and secured to carriage member 205, rotation of threaded shaft 219 causes rail 207 to translate transversely relative to the cross tie. In this manner, transverse alignment of an end 291 of rail 207 with the end of an adjoining rail (not shown) can be achieved so that the two rails can be welded together.

Rail alignment tool 201 may include visual indicia 292 of a trim or default alignment condition. For example, a first indicator mark 294 may be placed on base member 203, and a second indicator mark 296 may be placed on carriage member 205. Alignment of indicator mark 294 with indicator mark 296 prior to installation of rail alignment tool 210 onto the cross tie ensures that carriage member 205 will be adjustable in either direction after installation. It will be understood that other types of indicator marks, such as graduated marks, may be used to position rail alignment tools 201 and align the adjacent rails for welding.

Figure 9A:
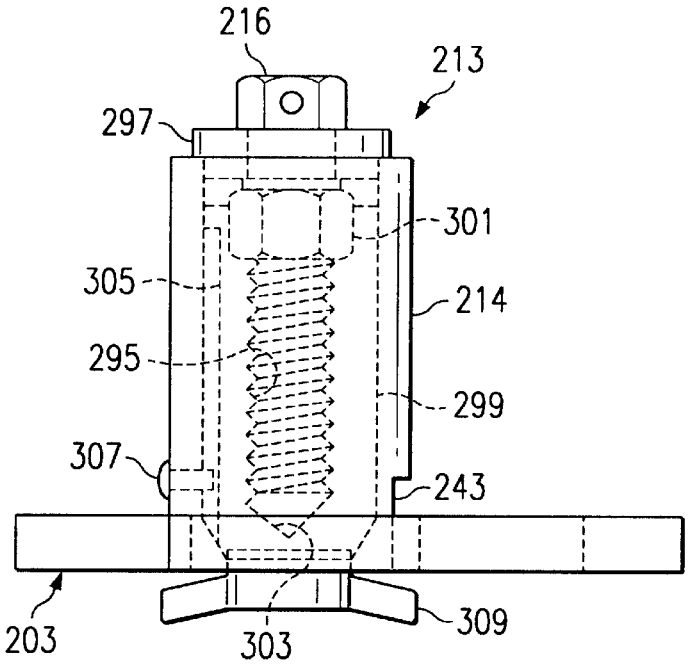
FIGS. 9A and 9B are front views of a jack member of the rail alignment tool of FIG. 7A illustrated in retracted and extended modes, respectively.
Figure 9B:
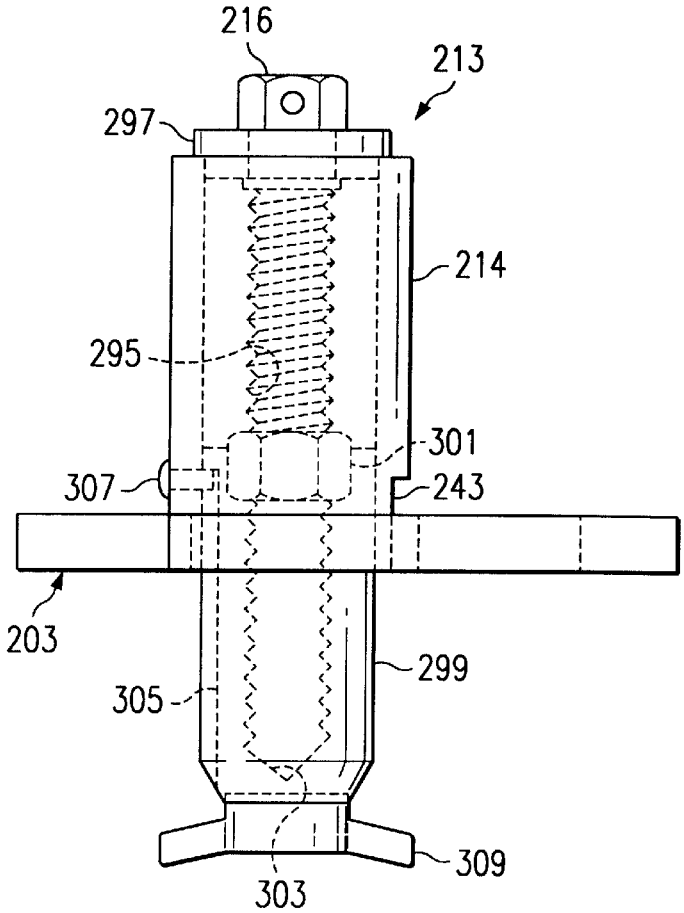

Referring specifically now to FIGS. 9A and 9B in the drawings, jack member 213 is illustrated in a retracted mode and an extended mode, respectively. Adjustment means 216 of jack member 213 includes a threaded shaft 295 disposed within sleeve portion 214. Threaded shaft 295 passes through a fixed thrust bearing 297 disposed at the upper end of sleeve portion 214. A jack foot 299 telescopes into sleeve portion 214. A receiver 301 having internal threads (not shown) matingly receives threaded shaft 295. Receiver 301 is fixed to the upper portion of jack foot 299. Jack foot 301 includes an internal shaft 303 into which threaded shaft is disposed when jack member is in the retracted mode. Jack foot 299 may include a key way 305 which receives a key 307. Key 307 and key way 305 ensure that jack foot 299 telescopes into an out of sleeve portion in a properly aligned manner. Jack foot 299 terminates with a toe portion 309 that is configured and adapted to engage the cross tie. Toe portion 309 may be pivotally coupled to jack foot 299 to provide a slight amount of angular tolerance between rail alignment tool 201 and the cross tie. It should be understood that one function of sleeve portion 214 is to prevent debris, such as welding debris, from being deposited on threaded shaft 295 and preventing jack member 213 from functioning properly.

Because adjustment means 216 and threaded shaft 295 pass through fixed thrust bearing 297, and because receiver 301 is fixed to jack foot 299, rotation of adjustment means 216 causes jack foot 299 to translate between the retraced mode of FIG. 9A and the extended mode of FIG. 9B. In the retracted mode, base member 203 is either in contact with or in close proximity to the cross tie. In the extended mode, base member 203 is lifted away from the cross tie. In this manner, vertical alignment of end 291 of rail 207 with the end of an adjoining rail (not shown) can be achieved so that the two rails can be welded together.

Although the invention has been described with reference to particular embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that the appended claims will cover any such modifications or embodiments that fall within the scope of the invention.

What is claimed is:

1. A rail alignment system for selectively aligning an end section of a first rail with an end section of a second rail, the rail alignment system comprising:

a first rail alignment tool for adjusting the vertical and lateral position of the end section of the first rail, the first rail alignment tool comprising:

a first base member adapted to be coupled to a first cross tie disposed beneath the first rail;

a means for coupling the first base member to the first cross tie;

a first carriage assembly slidingly coupled to the first base member, such that the first carriage assembly slides in a direction generally transverse to the first rail;

a means for coupling the first carriage assembly to the first rail;

a means for adjusting the vertical position of the first carriage assembly relative to the first cross tie; and a means for adjusting the lateral position of the first carriage assembly relative to the first cross tie; and a second rail alignment tool for adjusting the vertical and lateral position of the end section of the second rail, the second rail alignment tool comprising:

a second base member adapted to be coupled to a second cross tie disposed beneath the second rail;

a means for coupling the second base member to the second cross tie;

a second carriage assembly slidingly coupled to the second base member, such that the second carriage assembly slides in a direction generally transverse to the second rail;

a means for coupling the second carriage assembly to the second rail;

a means for adjusting the vertical position of the second carriage assembly relative to the cross tie; and a means for adjusting the lateral position of the second carriage assembly relative to the cross tie;

wherein the end section of the first rail is selectively aligned by adjustment of the means for adjusting the vertical position of the first carriage assembly and the means for adjusting the lateral position of the first carriage assembly, and the end section of the second rail is selectively aligned by adjustment of the means for adjusting the vertical position of the second carriage assembly and the means for adjusting the lateral position of the second carriage assembly.

2. The rail alignment system according to claim 1, wherein the means for coupling the first base member to the first cross tie is at least one aperture passing through the first base member for receiving a spike, and the means for coupling the second base member to the second cross tie is at least one aperture passing through the second base member for receiving a spike.

3. The rail alignment system according to claim 1, wherein the means for coupling the first base member to the first cross tie is at least one tab member extending outward from the first base member for engagement with the first cross tie, and the means for coupling the second base member to the second cross tie is at least one tab member extending outward from the second base member for engagement with the second cross tie.

4. The rail alignment system according to claim 1, wherein the means for coupling the first carriage assembly to the first rail comprises:

a first clamping member pivotally coupled to the first carriage assembly; and an opposing second clamping member pivotally coupled to the first carriage assembly;

wherein both the first clamping member and the second clamping member are configured to releasably secure the first rail to the first carriage assembly.

5. The rail alignment system according to claim 1, wherein the means for coupling the second carriage assembly to the second rail comprises:

a first clamping member pivotally coupled to the second carriage assembly; and an opposing second clamping member pivotally coupled to the second carriage assembly;

wherein both the first clamping member and the second clamping member are configured to releasably secure the second rail to the second carriage assembly.

6. The rail alignment system according to claim 1, wherein the first rail is carried by the first carriage assembly, and the second rail is carried by the second carriage assembly.

7. The rail alignment system according to claim 1, wherein the means for adjusting the vertical position of the first carriage assembly relative to the first cross tie is a jack member comprising:

a jack body coupled to the first base member;

a jack foot operably associated with the jack body, the jack foot being adapted for engagement with the first cross tie; and a means for adjusting the position of the jack foot relative to the jack body;

wherein actuation of the means for adjusting the position of the jack foot relative to the jack body causes a corresponding adjustment of the vertical position of the first carriage assembly relative to the first cross tie.

8. The rail alignment system according to claim 7, wherein the means for adjusting the position of the jack foot relative to the jack body is a threaded shaft coupled to the jack foot and the jack body.

9. The rail alignment system according to claim 1, wherein the means for adjusting the vertical position of the second carriage assembly relative to the second cross tie is a jack member comprising:

a jack body coupled to the second base member;

a jack foot operably associated with the jack body, the jack foot being adapted for engagement with the second cross tie; and a means for adjusting the position of the jack foot relative to the jack body;

wherein actuation of the means for adjusting the position of the jack foot relative to the jack body causes a corresponding adjustment of the vertical position of the second carriage assembly relative to the second cross tie.

10. The rail alignment system according to claim 9, wherein the means for adjusting the position of the jack foot relative to the jack body is a threaded shaft coupled to the jack foot and the jack body.

11. The rail alignment system according to claim 1, wherein the means for adjusting the lateral position of the first carriage assembly relative to the first cross tie is an adjustment member comprising:

a receiver coupled to the first carriage assembly;

a block member coupled to the first base member; and an adjusting member operably associated with the receiver and the block member;

wherein actuation of the adjusting member causes a corresponding adjustment of the lateral position of the first carriage assembly relative to the first cross tie.

12. The rail alignment system according to claim 1, wherein the means for adjusting the lateral position of the second carriage assembly relative to the second cross tie is an adjustment member comprising:

a receiver coupled to the second carriage assembly;

a block member coupled to the second base member; and an adjusting member operably associated with the receiver and the block member;

wherein actuation of the adjusting member causes a corresponding adjustment of the lateral position of the second carriage assembly relative to the second cross tie.

13. The rail alignment system according to claim 1, further comprising:

a first handle member coupled to the first rail alignment tool; and a second handle member coupled to the second rail alignment tool.

14. The rail alignment system according to claim 1, further comprising:

first visual indicia disposed upon the first rail alignment tool for indicating a trim position for the first carriage assembly relative to the first base member; and second visual indicia disposed upon the second rail alignment tool for indicating a trim position for the second carriage assembly relative to the second base member.

15. The rail alignment system according to claim 1, further comprising:

at least one first guide member for guiding the translation of the first carriage assembly relative to the first base member; and at least one second guide member for guiding the translation of the second carriage assembly relative to the second base member.

16. A rail alignment tool for adjusting the vertical and lateral position of an end section of a rail, the rail alignment tool comprising:

a base member adapted to be coupled to a cross tie disposed beneath the rail;

a means for coupling the base member to the cross tie;

a carriage assembly slidingly coupled to the base member, such that the carriage assembly translates in a direction generally transverse to the rail;

a means for releasably securing the carriage assembly to the rail;

at least one jack assembly for adjusting the vertical position of the carriage assembly relative to the base member; and an adjustment assembly for adjusting the lateral position of the carriage assembly relative to the cross tie;

wherein the vertical position of the end section of the rail is located by actuation of the jack assembly, and the lateral position of the end section of the rail is located by actuation of the adjustment assembly.

17. The rail alignment tool according to claim 16, wherein the means for coupling the base member to the cross tie is at least one aperture passing through the base member for receiving a spike.

18. The rail alignment tool according to claim 16, wherein the means for coupling the base member to the cross tie is at least one tab member extending outward from the base member for engagement with the cross tie.

19. The rail alignment tool according to claim 16, wherein the means for releasably securing the carriage assembly to the rail comprises:

a first clamping member pivotally coupled to the carriage assembly; and an opposing second clamping member pivotally coupled to the carriage assembly;

wherein both the first clamping member and the second clamping member are configured to releasably secure the second rail to the second carriage assembly.

20. The rail alignment tool according to claim 16, wherein the adjustment assembly comprises:

a receiver carried by the carriage assembly;

a fixed block carried by the base member; and a single adjustment shaft operably associated with both the receiver and the fixed block;

wherein actuation of the single adjustment shaft adjusts the lateral position ofd the rail relative to the cross tie.

* * * * *